US010415877B2

(12) United States Patent
Faehnle et al.

(10) Patent No.: US 10,415,877 B2
(45) Date of Patent: Sep. 17, 2019

(54) REFRIGERATION APPLIANCE WITH A MONITORING DEVICE

(71) Applicant: BSH HAUSGERAETE GMBH, Munich (DE)

(72) Inventors: Elmar Faehnle, Eichingen (DE); Eugen Gaplikow, Guenzburg (DE); Michael Krapp, Nattheim (DE)

(73) Assignee: BSH Hausgeraete GmbH, Munich (DE)

( * ) Notice: Subject to any disclaimer, the term of this patent is extended or adjusted under 35 U.S.C. 154(b) by 803 days.

(21) Appl. No.: 14/407,686

(22) PCT Filed: Jun. 7, 2013

(86) PCT No.: PCT/EP2013/061764
§ 371 (c)(1),
(2) Date: Dec. 12, 2014

(87) PCT Pub. No.: WO2013/186126
PCT Pub. Date: Dec. 19, 2013

(65) Prior Publication Data

US 2015/0121924 A1 May 7, 2015

(30) Foreign Application Priority Data

Jun. 12, 2012 (DE) ..... 10 2012 209 817

(51) Int. Cl.
*F25D 29/00* (2006.01)
*F25D 23/12* (2006.01)
(Continued)

(52) U.S. Cl.
CPC ..... *F25D 29/003* (2013.01); *F25D 11/00* (2013.01); *F25D 23/126* (2013.01); *F25D 29/00* (2013.01); *F25D 31/002* (2013.01)

(58) Field of Classification Search
CPC ..... F25D 23/126; F25D 29/003; F25D 29/00; F25D 11/00; F25D 31/002; F25D 29/008;
(Continued)

(56) References Cited

U.S. PATENT DOCUMENTS 2,527,308 A * 10/1950 Jackson ..... F25D 23/126 62/150
2,532,074 A * 11/1950 Alexis ..... F25B 49/005 137/206
(Continued)

FOREIGN PATENT DOCUMENTS

| | | |
|---|---|---|
| CN | 102410681 A | 4/2012 |
| WO | 2006014891 A1 | 2/2006 |
| WO | 2006097838 A2 | 9/2006 |

*Primary Examiner* — Joseph F Trpisovsky
(74) *Attorney, Agent, or Firm* — Laurence A. Greenberg; Werner H. Stemer; Ralph E. Locher

(57) ABSTRACT

A refrigeration appliance includes a water-conducting conduit system which has a connector for connecting to a domestic water supply system. A monitoring device is configured to detect water leaks in the water-conducting conduit system of the refrigeration appliance. A monitoring device for installation into a refrigeration appliance and a monitoring device housing for such a monitoring device are also provided.

10 Claims, 7 Drawing Sheets

(51) Int. Cl.
*F25D 11/00* (2006.01)
*F25D 31/00* (2006.01)

(58) Field of Classification Search
CPC ..... F25D 29/006; F25D 29/005; Y10T 137/5762; B67D 7/3209; B67D 7/3254; B67D 2210/00062; F25C 2500/06; F25C 2400/14; F25C 2700/04; E03B 7/071; A47L 15/4212
USPC ..... 62/126, 129, 189; 340/605; 137/312
See application file for complete search history.

(56) References Cited

U.S. PATENT DOCUMENTS 3,690,151 A * 9/1972 Briggs ..... G01M 3/202 73/40.7
4,138,856 A * 2/1979 Orlowski ..... F25B 49/005 165/11.1
5,574,213 A * 11/1996 Shanley ..... G01M 3/38 73/40.7
6,024,116 A * 2/2000 Almberg ..... F16K 31/003 122/504
6,253,785 B1 * 7/2001 Shumake, Jr. ..... F16K 21/18 122/504
7,810,345 B2 * 10/2010 Nebbia ..... F25D 21/14 222/146.6
2003/0010055 A1 * 1/2003 Kuroyanagi ..... F25C 1/147 62/354
2005/0139552 A1 * 6/2005 Forsberg ..... E03B 3/28 62/635
2006/0027267 A1 * 2/2006 Fritze ..... F17D 5/02 137/487.5

* cited by examiner

REFRIGERATION APPLIANCE WITH A MONITORING DEVICE

BACKGROUND OF THE INVENTION

Field of the Invention

The invention relates to a refrigeration appliance with a water-conducting conduit system, which has a connector for connecting to a domestic water supply system. The invention further relates to such a monitoring device for installation in such a refrigeration appliance and a monitoring device housing for such a monitoring device.

Refrigeration appliances, in particular refrigeration appliances configured as domestic appliances, are known and are used for domestic management in domestic situations or the field of catering, to store perishable food and/or beverages at defined temperatures. Such refrigeration appliances also have an ice cube maker and/or a water dispenser, which is supplied with drinking water by way of a connector to a domestic water supply system in order to produce and then supply ice cubes/chilled water therefrom. A water leak in the water-conducting conduit system of such an ice cube maker can however also result in an escape of leaked water and therefore water damage. Water stop valves for water-conducting domestic appliances, as disclosed in DE 10 2007 009 510 A1, are known to prevent such water damage.

BRIEF SUMMARY OF THE INVENTION

It is therefore the object of the invention to provide a refrigeration appliance that is simple to manufacture and significantly reduces the risk of water damage. It is also the object of the invention to provide a monitoring device for a refrigeration appliance that is simple to fit.

These objects are achieved by the subject matter with the features as claimed in the independent claims. Advantageous developments are set out in the dependent claims.

The present invention is based on the knowledge that operating safety is enhanced by a monitoring device and the risk of water damage as a result of water leaks can therefore be significantly reduced.

According to a first aspect the inventive object is achieved by a refrigeration appliance with a water-conducting conduit system, which has a connector for connecting to a domestic water supply system, a monitoring device being configured to detect water leaks in the water-conducting conduit system of the refrigeration appliance. This has the technical advantage that water leaks can be identified and eliminated promptly or countermeasures can be initiated before water damage of significant proportions results.

A refrigeration appliance refers in particular to a domestic appliance, in other words a refrigeration appliance, which is used for domestic management in domestic situations or the field of catering and serves in particular to store food and/or beverages at defined temperatures, for example a refrigerator, upright freezer, combined refrigerator/freezer, chest freezer or wine chiller.

In one advantageous embodiment the monitoring device is connected to a water stop valve and when a water leak is detected, the monitoring device switches the water stop valve from an open to a blocking state. This has the technical advantage that when a water leak is detected, the water supply from the domestic water supply system is stopped by blocking the water stop valve. Thus the closing action of the water stop valve prevents the unimpeded escape of leaked water in the event of a water leak and thus limits possible water damage.

In one advantageous embodiment the monitoring device has a water leak detection device, which is arranged in the interior of the housing of the refrigeration appliance. The water leak detection device detects for example whether leaked water is collecting in a collector or a collection trough. Alternatively the water leak detection device monitors for example the water pressure in the conduit system of the refrigeration appliance. A water leak is then detected based on a drop in the water pressure. This has the technical advantage that the conduit system of the refrigeration appliance can be permanently monitored and an unwanted escape of water in the event of a water leak is immediately counteracted.

In one advantageous embodiment the water leak detection device is arranged in the machine chamber of the refrigeration appliance. This has the technical advantage that the water leak detection device itself does not take up any space outside the refrigeration appliance. Such a refrigeration appliance can therefore be installed with an accurate fit in a unit recess.

In one advantageous embodiment the water leak detection device is fastened with a form fit to a support rail arranged in the machine chamber. This has the technical advantage that no additional fastening means are required or have to be fitted. This simplifies manufacture and reduces logistical complexity as no such fastening means have to be stocked. Alternatively the water leak detection device can also be fastened to other parts of the refrigeration appliance, for example side walls of the refrigeration appliance housing.

In one advantageous embodiment the water leak detection device is arranged at the lowest point of the conduit system. This has the technical advantage that leaked water that escapes due to a water leak and collects at the lowest point due to the force of gravity can be detected with simple means, for example a float switch.

In one advantageous embodiment the monitoring device has a monitoring device housing with a collection trough for leaked water. Parts of the monitoring device or the entire monitoring device can be arranged in the monitoring device housing. This has the technical advantage that leaked water collects in the collection trough and does not escape from the refrigeration appliance. The fact that the collection trough is associated with the monitoring device housing, in particular the monitoring device housing and the collection trough are configured as a single piece, means that fitting is simplified further.

In one advantageous embodiment the monitoring device housing has a receiving chamber for the water leak detection device. This has the technical advantage that the water leak detection device is held in the monitoring device housing in such a manner that it is reliably protected from external environmental influences. Fitting is simplified at the same time, as no additional housing has to be fitted for the water leak detection device.

In one advantageous embodiment the monitoring device housing has a hose clip. This has the technical advantage that no additional fastening means are required or have to be fitted. This simplifies manufacture and reduces logistical complexity as no such fastening means have to be stocked.

In one advantageous embodiment the monitoring device housing is configured so that it is divided into two parts—an upper housing half and a lower housing half. This has the technical advantage that the monitoring device housing is particularly simple to manufacture, for example by plastic injection molding.

In one advantageous embodiment the upper housing half and the lower housing half are connected to one another by means of a latching connection. This has the technical advantage that no additional fastening means are required or have to be fitted. This simplifies manufacture and reduces logistical complexity as no such fastening means have to be stocked.

In a further advantageous embodiment a fastening element is associated with the monitoring device housing of the refrigeration appliance, said fastening element being able to pivot between a first position and a second position and having a horizontally extending bottom rib, which engages with an engaging segment of the support rail and is not engaged in the second position. The fastening element can be fastened to the monitoring device housing. The horizontally extending bottom rib of the fastening element extends in the same main extension direction as the bottom rib of the monitoring device housing at least in the first position or these two main extension directions run parallel to one another. The fastening element then brings about a form fit acting in the first direction in the first position. This has the technical advantage that moving the fastening element from the second position into the first position can bring about an engagement between the bottom ribs of the monitoring device housing and of the fastening element without the deployment of a tool being required for this purpose. It is thus possible to fit the monitoring device with for example a monitoring device housing with such a fastening element in a machine chamber of such a refrigeration appliance without a tool.

In a further advantageous embodiment the horizontally extending bottom rib of the fastening element has a perpendicularly extending positioning rib, which engages with a slot in the engaging segment. The perpendicularly extending positioning rib of the fastening element here extends in the same main extension direction as the longitudinal slot direction of the slot at least in its first position. This has the technical advantage that the engagement of the perpendicularly extending positioning rib with the slot improves the action of a form fit acting in the second direction with simple means.

In a further advantageous embodiment the fastening element can be pivoted about an axis between the first position and the second position, said axis running along a longitudinal extension of the support rail. The support rail here runs with its main extension direction on the one hand essentially horizontal, in other words essentially perpendicular to the vertical direction, when the refrigeration appliance is in its operating position. On the other hand the support rail runs between the side walls of the refrigeration appliance in such a manner that the main extension direction of the support rail extends essentially perpendicular to the depthwise direction of the refrigeration appliance. This has the technical advantage that a particularly simply configured fastening element can be used to fit the monitoring device housing, which in turn simplifies manufacture.

According to a second aspect the inventive object is achieved by a monitoring device for installation in a refrigeration appliance with a water-conducting conduit system, with which a connector for connecting to a domestic water supply system is associated, the monitoring device being configured to detect water leaks in the conduit system of the refrigeration appliance. Such a monitoring device allows the operating safety of such a refrigeration appliance to be further enhanced, in particular when a refrigeration appliance is retrofitted with such a monitoring device in the manner of an upgrade kit.

According to a third aspect the inventive object is achieved by a monitoring device housing for a monitoring device for installation in a refrigeration appliance with a water-conducting conduit system, with which a connector for connecting to a domestic water supply system is associated, the monitoring device being configured to detect water leaks in the conduit system of the refrigeration appliance, the monitoring device housing having a collection trough for leaked water.

The invention allows the provision of a refrigeration appliance with enhanced operating safety, as a water stop valve automatically interrupts any further water supply in the event of a water leak in the water-conducting conduit system.

BRIEF DESCRIPTION OF THE SEVERAL VIEWS OF THE DRAWING

Further exemplary embodiments are explained with reference to the accompanying drawings, in which.

DESCRIPTION OF THE INVENTION

Figure 1:
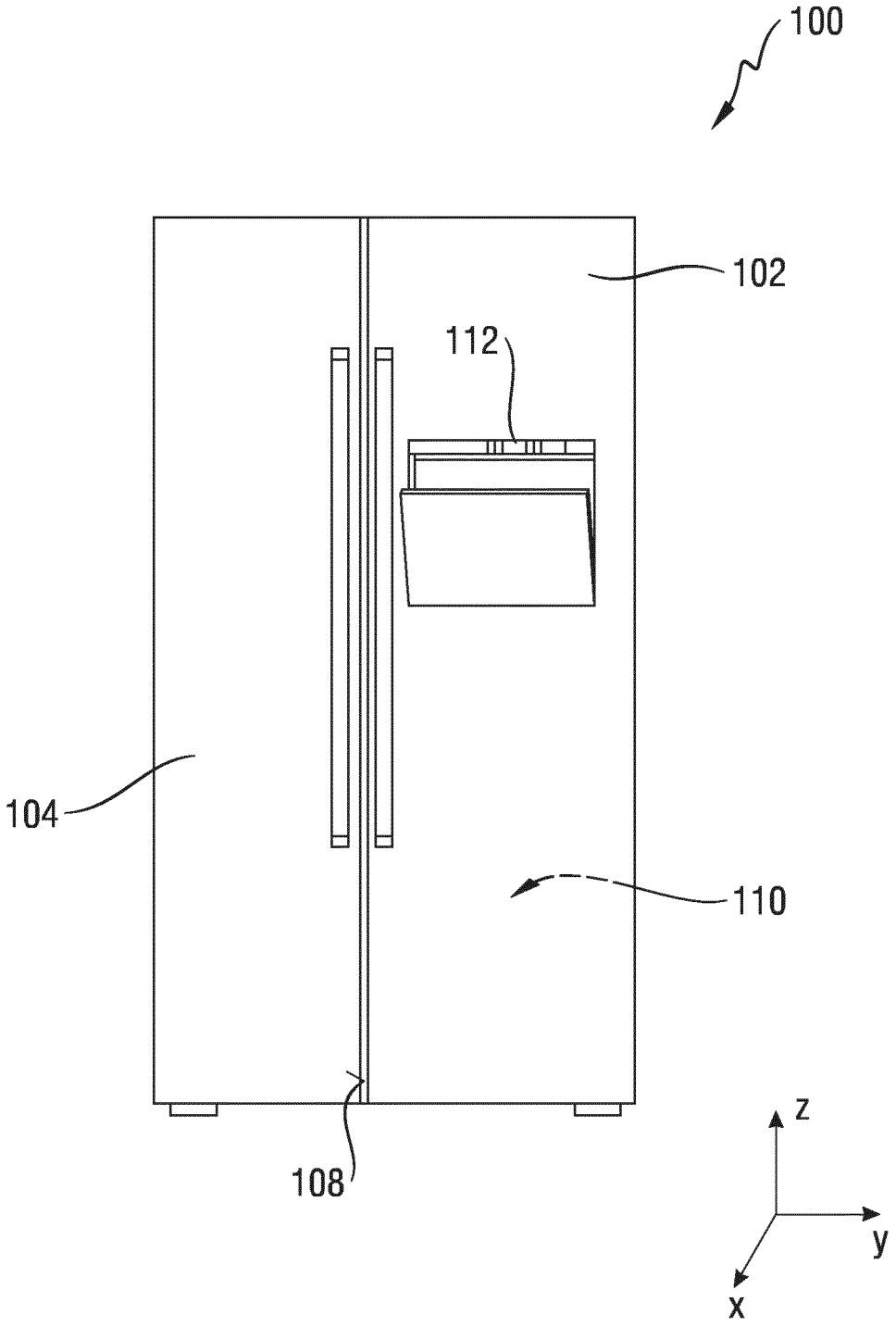
FIG. 1 shows a front view of a refrigeration appliance.

FIG. 1 shows a refrigerator as an exemplary embodiment of a refrigeration appliance 100 with a right refrigerator door 102 and a left refrigerator door 104 on its refrigeration appliance front face 108. The refrigerator serves by way of example to chill food and comprises a refrigerant circuit with an evaporator (not shown), a compressor 202 (see FIG. 2), a condenser (not shown) and a throttle unit (not shown).

The evaporator is configured as a heat exchanger, in which the liquid refrigerant expands and is then evaporated by absorbing heat from the medium to be cooled, in other words air in the interior of the refrigerator.

The compressor 202 is a mechanically operated component, which takes in evaporated refrigerant from the evaporator and ejects it to the condenser at a higher pressure.

The condenser is configured as a heat exchanger in which the evaporated refrigerant is compressed and then condensed by emitting heat to an external cooling medium, i.e. the ambient air.

The throttle unit is an apparatus that constantly reduces pressure by cross section reduction.

The refrigerant is a fluid used to transmit heat in the cold-generating system that absorbs heat when the fluid is at low temperatures and low pressure and emits heat when the fluid is at a higher temperature and pressure, with state changes generally also taking place in the fluid.

Integrated in the right refrigerator door 102 is an ice cube dispenser 112, which is connected to the refrigerant circuit to produce and supply ice cubes from liquid water. The ice cube dispenser 112 here is supplied with water from a domestic water supply system (not shown) by way of a water-conducting connection (not shown) of the water-conducting conduit system (not shown) of the refrigeration appliance 100.

Figure 2:
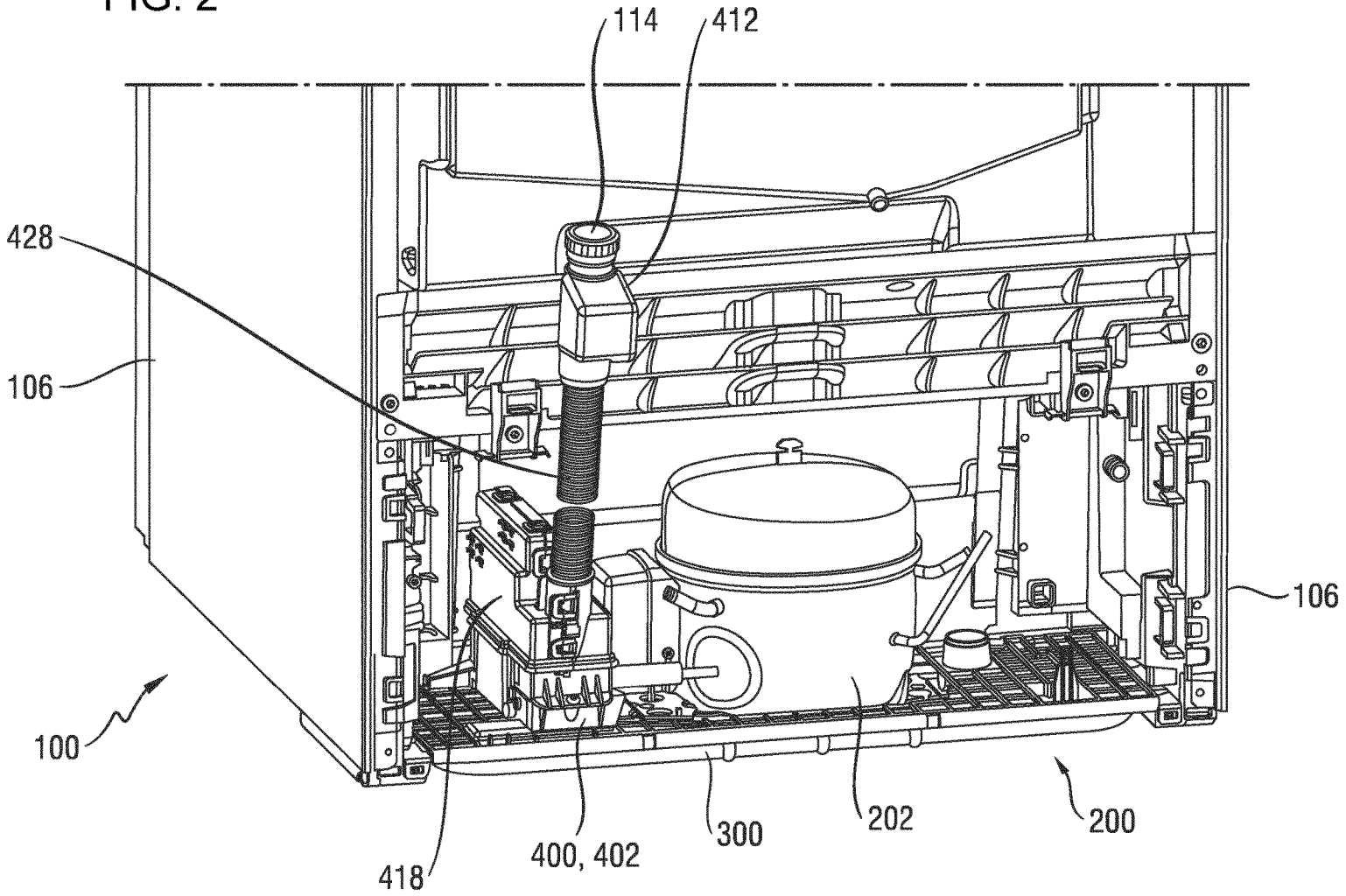
FIG. 2 shows a rear view of the refrigeration appliance from FIG. 1.

FIG. 2 shows the refrigeration appliance rear face 110 of the refrigeration appliance 100. Located in the lower region of the refrigeration appliance 100 is a machine chamber 200, in which, of the components of the refrigerant circuit and its controller accommodated in the machine chamber 200, the compressor 202 is shown. The compressor 202 is connected to a support rail 300, which extends in the refrigeration appliance widthwise direction Y between the side walls 106.

Also arranged in the machine chamber 200 adjacent to the compressor 202 is a monitoring device 400, which is associated with a water-conducting conduit system (not shown) of the refrigeration appliance 100, which has a connector 114 for connecting to a domestic water supply system. This monitoring device 400 is configured to detect a water leak in the water-conducting conduit system of the refrigeration appliance 100 and then to interrupt the water supply from the domestic water supply system in order thus to limit water damage. The monitoring device 400 has a water stop valve 412 arranged at one end of a hose 428 for connecting to a domestic water supply system, which can be activated by way of signal lines (not shown) by a water leak detection device 414 in the interior of a monitoring device housing 402 of the monitoring device 400 to prevent any further supply of water if the controller has detected a water leak in the conduit system. The monitoring device housing 402 is configured in two parts and consists of a lower housing half 416 and an upper housing half 418. In the present exemplary embodiment both housing halves are manufactured from plastic by means of plastic injection molding.

Figure 3:
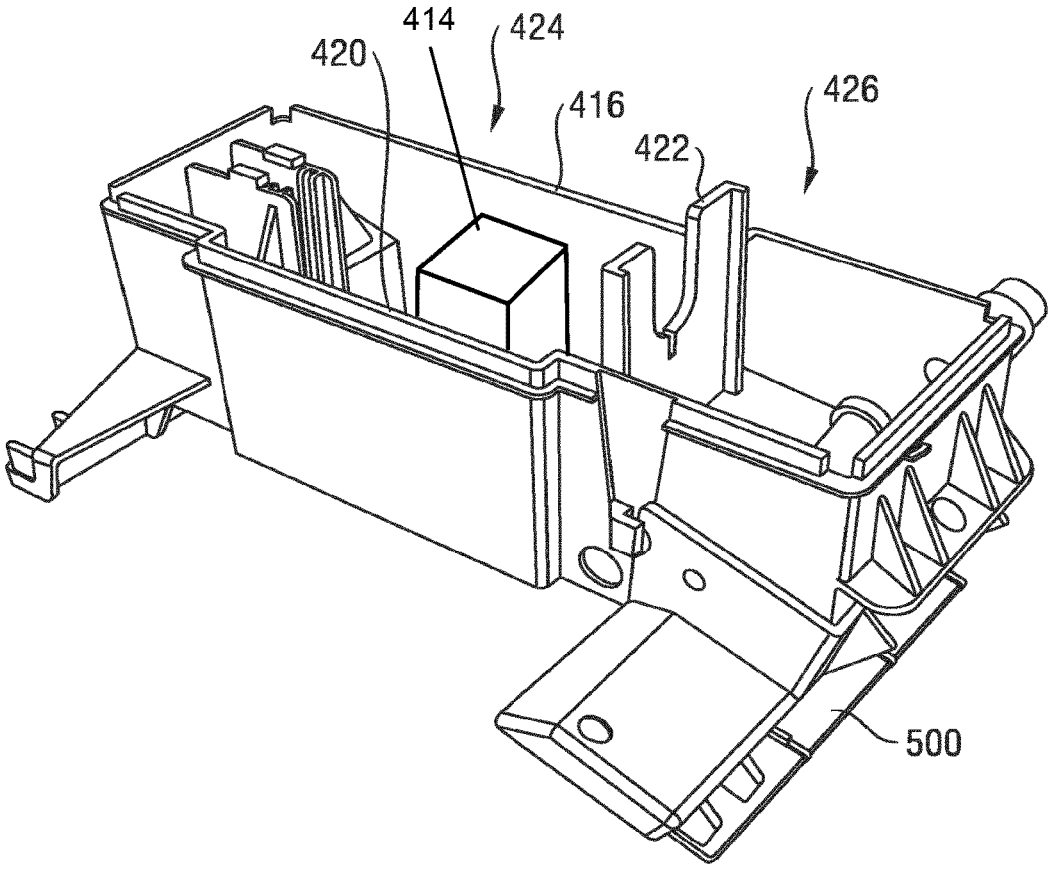
FIG. 3 shows a perspective view of a lower housing half of a monitoring device housing.

FIG. 3 shows the lower housing half 416 of the monitoring device housing 402. The lower housing half 416 has a latching connection element 420 to form a latching connection with the upper housing half 418. Arranged in the interior of the lower housing half 416 is a hose clip 422 for fastening the end of the hose 428 opposite the end on which the water stop valve 412 is arranged.

The hose clip 422 divides the interior of the lower housing half 416 into two parts, namely a collection trough 426 for leaked water that flows through the hose 428 into the collection trough 426 in the event of a water leak, until the water stop valve 412 stops the further supply of water, and a receiving chamber 426 for receiving the water leak detection device 414, which is connected by way of the above-mentioned signal lines to the water stop valve 412. In the present exemplary embodiment the water leak detection device 414 is configured to detect leaked water collecting in the collection trough 424 in the event of a water leak. To this end the water leak detection device 414 is associated with a float switch (not shown), which is arranged on the bottom of the collection trough 424. The water leak detection device 414 is expediently arranged at the lowest point of the conduit system of the refrigeration appliance 100 in its operating position, in other words where leaked water collects due to the force of gravity.

During operation the water stop valve 412 is open while a water inlet valve (not shown) of the conduit system is closed. Thus in order to perform a filling operation by drawing water from the domestic supply network only the water inlet valve has to be open. If, as a result of a water leak, leaked water collects in the collection trough 424, it is detected by the float switch arranged on the bottom of the collection trough 424 and therefore by the water leak detection device 414. The water leak detection device 414 then generates a control signal, which is transmitted through the signal lines to the water stop valve 412 and prompts the water stop valve 412 to switch from the open to the blocking state, thereby stopping any further supply of water. Any further escape of water is therefore prevented and the collection trough 424 only has to receive the quantity of water that escapes during the time period between the water leak occurring and the water stop valve 412 closing.

In the present exemplary embodiment the monitoring device housing 402 is also fastened to the support rail 300 in the same manner as the compressor 202.

The structure of the monitoring device housing 402 and its fastening to the support rail 300 are described with additional reference to FIGS. 4 to 7.

When installed in the machine chamber 200 the monitoring device housing 402 has two bottom ribs 404 on its front face 408 facing the front face 108 of the refrigeration appliance 100, these extending essentially horizontally. The bottom ribs 404 here are configured in such a manner that they can be made to engage with a front face engaging segment 302 of the support rail 300, which in the present exemplary embodiment is configured by beading the edges of a segment of the support rail 300. In the present exemplary embodiment the front face engaging segment 302 extends along the entire longitudinal face of the support rail 300 in its main extension direction between the two side walls 106 of the refrigeration appliance 100, which therefore runs in the refrigeration appliance widthwise direction Y. The engagement of the bottom ribs 404 with the front face engaging segment 302 therefore brings about the fixing of the water stop valve 400 in the refrigeration appliance depthwise direction X and the refrigeration appliance heightwise direction Z by forming a form fit.

One of the two bottom ribs 404 has a positioning rib 406, which extends in a perpendicular manner from the horizontally extending bottom rib 404. The main extension direction of the positioning rib 406 therefore runs in the direction of the refrigeration appliance heightwise direction Z. In a suitable segment, which is located in the present exemplary embodiment in the region of the front face engaging segment 302, the support rail 300 has a front face slot 306, the slot direction of which also runs in the refrigeration appliance depthwise direction X. The engagement of the positioning rib 406 with the front face slot 306 therefore brings about the fixing of the water stop valve 400 in the refrigeration appliance widthwise direction Y by forming a form fit.

The monitoring device housing 402 has a fastening element 500 on its rear face 410 facing the rear face 110 of the refrigeration appliance 100.

Figure 8:
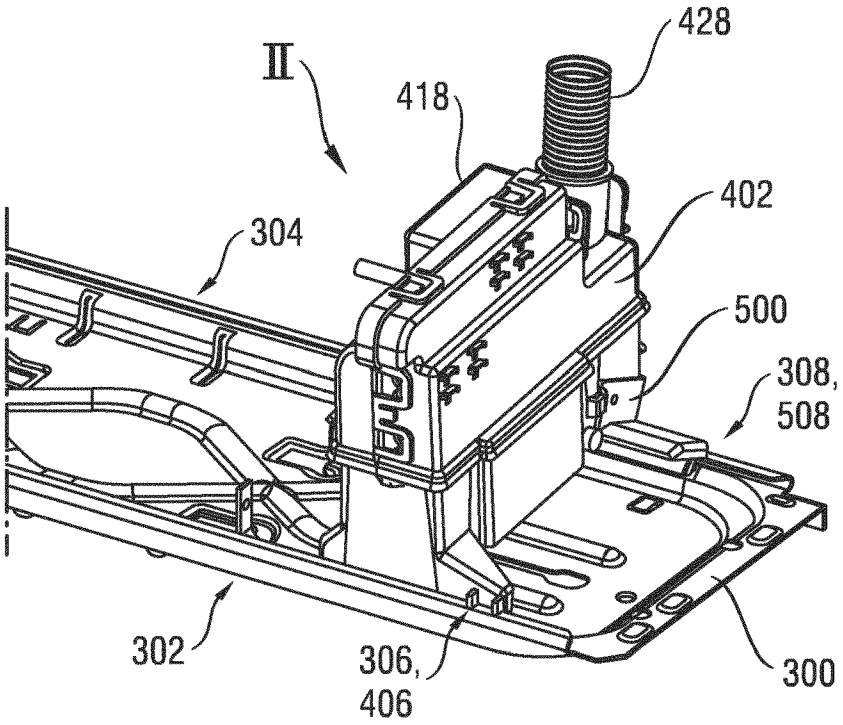
FIG. 8 shows a perspective view of a monitoring device housing and a fastening element for a refrigeration appliance during fitting.
Figure 4:
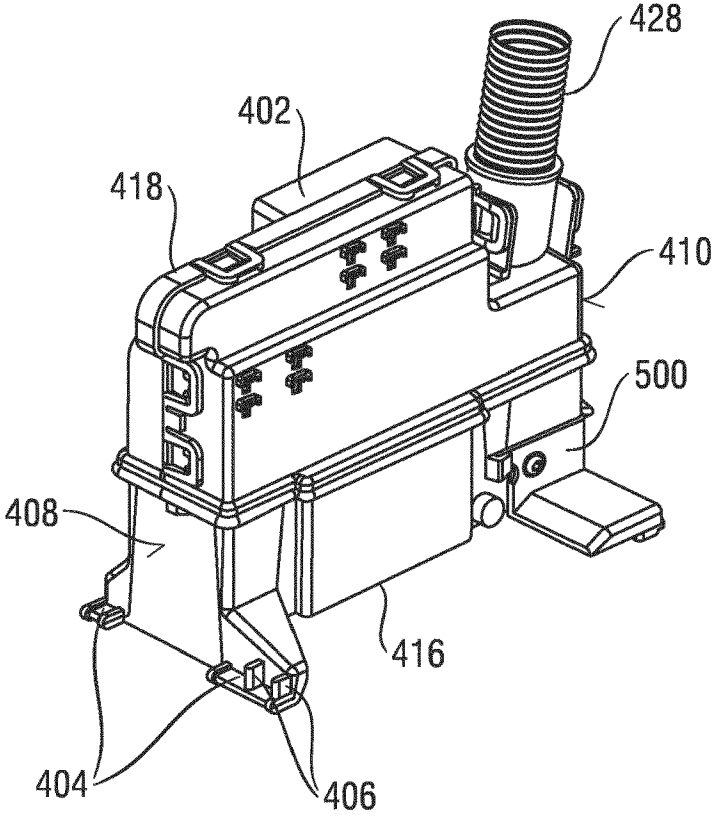
FIG. 4 shows a perspective view of a monitoring device hosing and a fastening element for a refrigeration appliance as shown in FIGS. 1 and 2.
Figure 7:
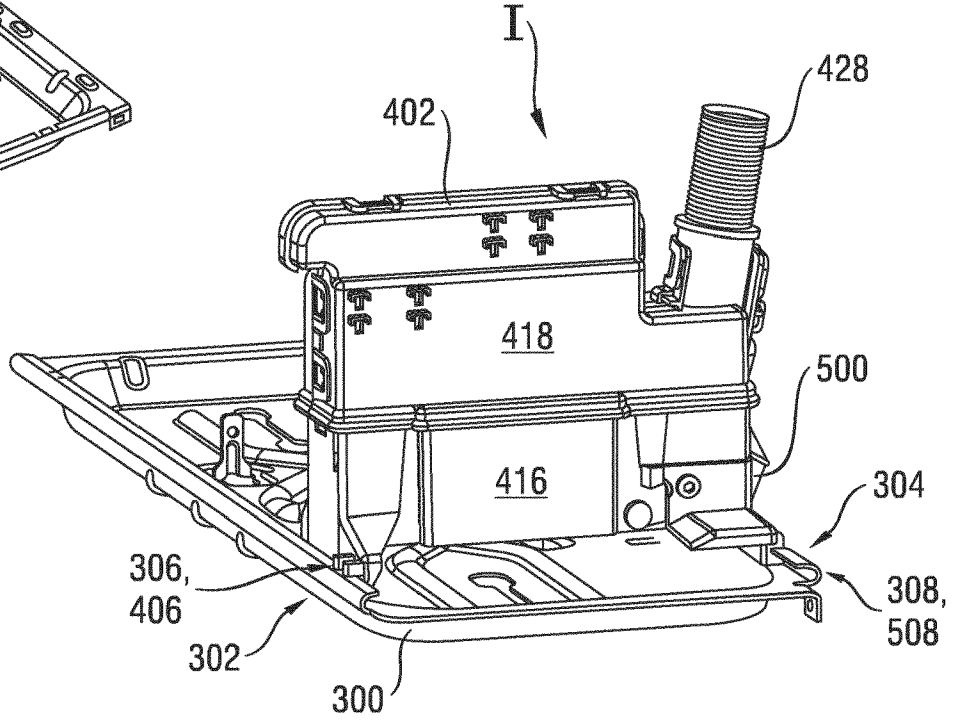
FIG. 7 shows a further perspective view of a support rail with a monitoring device housing for a refrigeration appliance after fitting.
Figure 5:
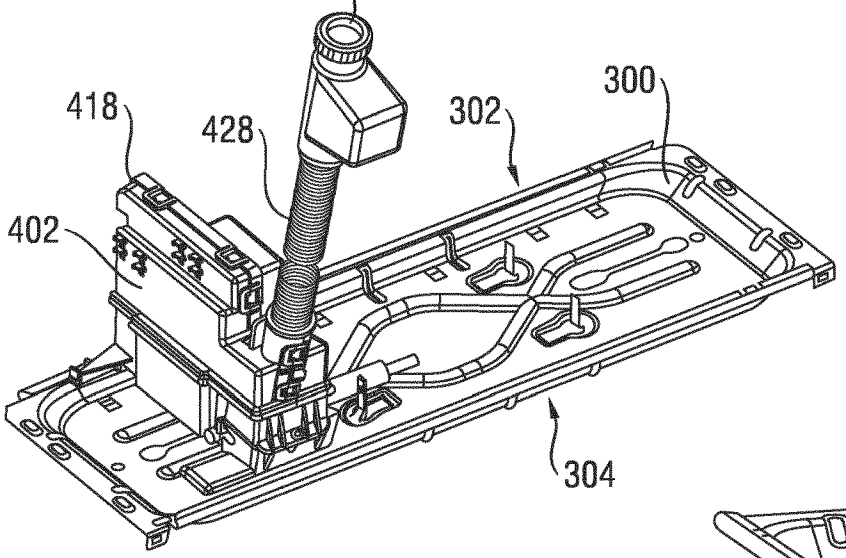
FIG. 5 shows a perspective view of a support rail with a monitoring device housing for a refrigeration appliance as shown in FIGS. 1 and 2.
Figure 9:
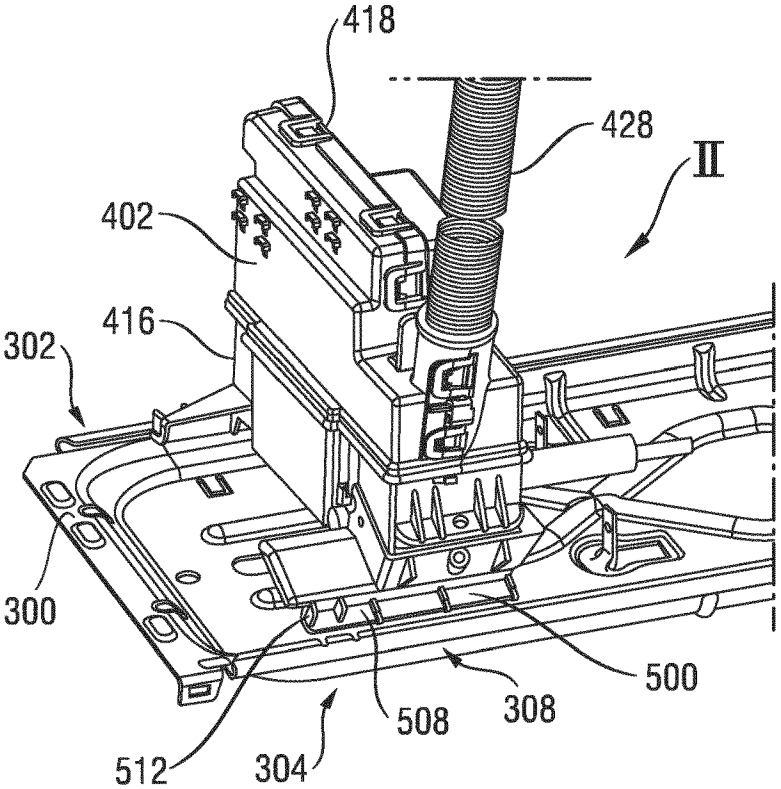
FIG. 9 shows a further perspective view of the monitoring device housing and a fastening element for a refrigeration appliance during fitting.
Figure 6:
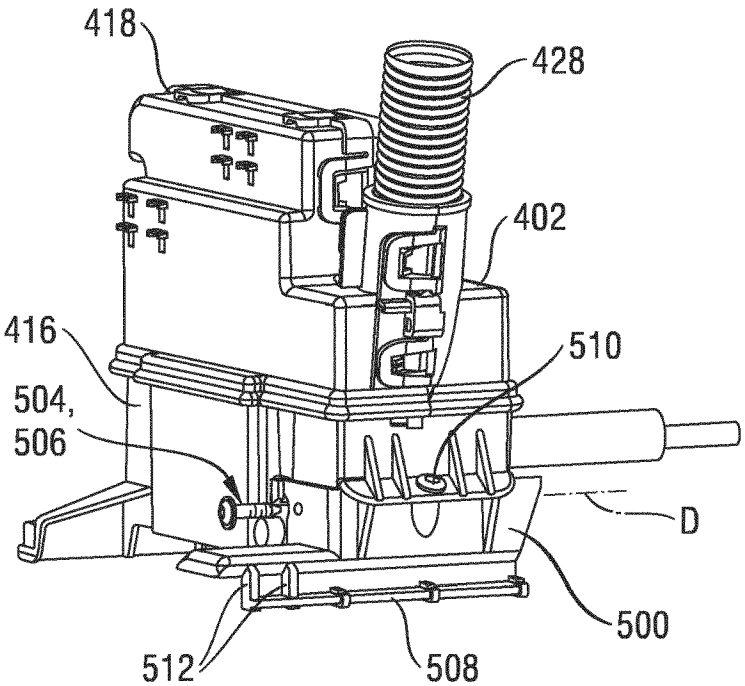
FIG. 6 shows a further perspective view of the monitoring device housing and a fastening element for a refrigeration appliance as shown in FIGS. 1 and 2.
Figure 11:
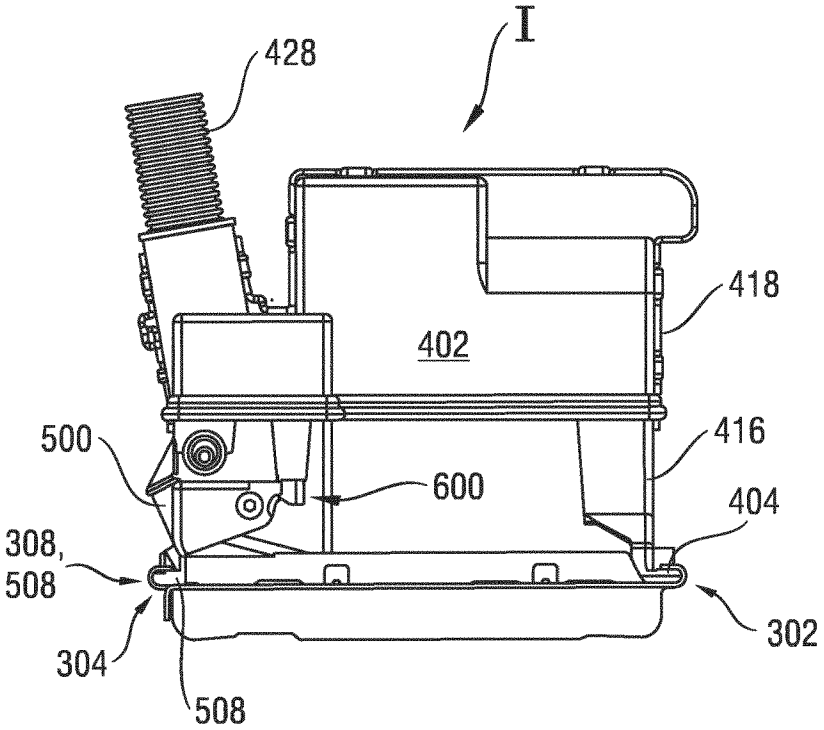
FIG. 11 shows a side view of the support rail with a monitoring device housing for a refrigeration appliance after fitting.
Figure 10:
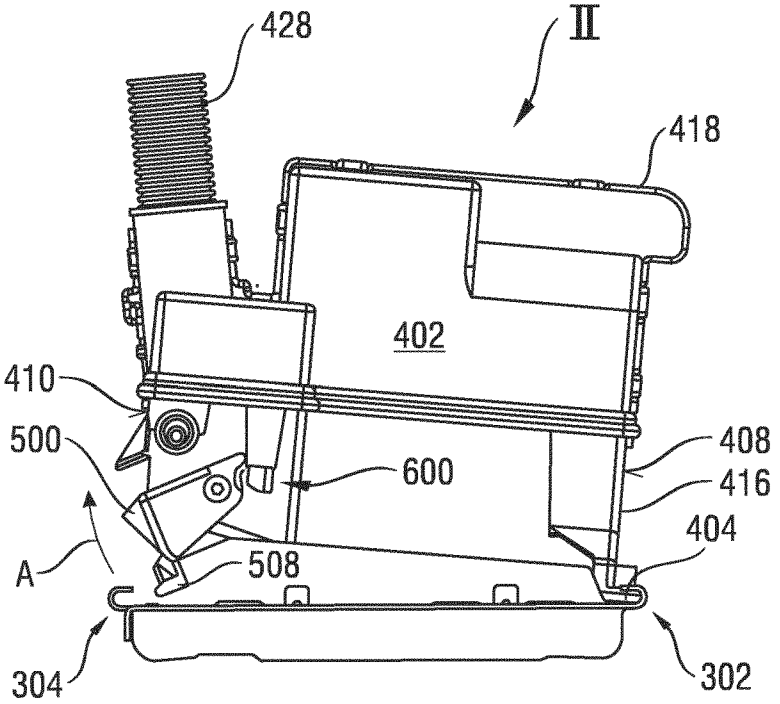
FIG. 10 shows a side view of the support rail with a monitoring device housing for a refrigeration appliance during fitting.

The fastening element 500 can be moved between a first position I (see FIG. 7) and a second position II (see FIGS. 8 and 9). To this end the fastening element 500 has a screw boss 504, into which a screw 506 is introduced. The longitudinal axis of the screw 506 introduced into the screw boss 504 therefore defines the pivot movement direction in the direction of the arrow A, with the rotation axis D of the pivot movement running parallel to the main extension direction of the support rail 300 and therefore in the direction of the refrigeration appliance widthwise direction Y in the present exemplary embodiment. To fix the fastening element 500 in the first position I, the fastening element 500 has a hole, into which a fixing screw 510 can be introduced. In the present exemplary embodiment the hole has an internal thread (not shown). Fixing can also take place with latching hooks instead of a hole.

In the present exemplary embodiment the fastening element 500 has a bottom rib 508 that extends over the entire width of the fastening element 500 in the refrigeration appliance widthwise direction Y, extending essentially horizontally. The bottom rib 508 here is configured in such a manner that it can be made to engage with a rear face engaging segment 304 of the support rail 300, which in the present exemplary embodiment is configured by beading the edges of a segment of the support rail 300 in the same manner as the front face engaging segment 302. In the present exemplary embodiment the rear face engaging segment 304 also extends along the entire longitudinal face of the support rail 300 in its main extension direction. The engagement of the bottom rib 508 with the rear face engaging segment 304 therefore brings about the fixing of the monitoring device 400 in the refrigeration appliance depthwise direction X and the refrigeration appliance heightwise direction Z by forming a form fit when the fastening element 500 is in the first position I.

The bottom rib 508 has a positioning rib 512, which extends in a perpendicular manner from the horizontally extending bottom rib 508. The main extension direction of the positioning rib 512 therefore runs in the direction of the refrigeration appliance heightwise direction Z. In a suitable segment, which in the present exemplary embodiment is located in the region of the rear face engaging segment 304, the support rail 300 has a further rear face slot 308, the slot direction of which runs in the refrigeration appliance depthwise direction X. The engagement of the positioning rib 512 with the rear face slot 308 therefore brings about the fixing of the monitoring device 400 in the refrigeration appliance widthwise direction B by forming a form fit.

The fitting of the monitoring device 400 with the monitoring device housing 402 and a fastening element 500 that is fastened thereto and can be moved between the first position I and the second position II is now described with reference to FIGS. 8 to 11, it being possible for such fitting to take place in the interior of the machine chamber 200, in other words with the support rail 300 already fitted in the machine chamber 200. In this state the end face ends of the support rail 300 are no longer freely accessible so the bottom rib 404 for example cannot be threaded into the end face.

At the start the fastening element 500 is in the second position II. The monitoring device housing 402 is first positioned on the support rail 300 in such a manner that the bottom rib 404 and the positioning rib 406 on the front face 408 of the monitoring device housing 402 are made to engage in the front face engaging segment 302 and the front face slot 306 (see FIGS. 7, 8 and 10).

In a further step the monitoring device housing 402 is lowered until the bottom rib 508 of the fastening element 500 comes into contact with the rear face engaging segment 304 of the support rails 300. Continuing the lowering movement causes the fastening element 500 to be pivoted in the direction of the arrow A about the rotation axis A until the first position I is reached. In this process the bottom rib 508 engages with the rear face engaging segment 304 and the positioning rib 512 of the fastening element 500 engages with the rear face slot 308, thereby fixing the monitoring device housing 402 in the refrigeration appliance depthwise direction X, in the refrigeration appliance widthwise direction Y and in the refrigeration appliance heightwise direction Z by a form fit. Further movement of the fastening element 500 is prevented by bridging ribs 600 here.

In a step that completes the fitting of the monitoring device housing 402 in the present exemplary embodiment the fixing screw 510 and/or latching hooks or comparable fastening means is/are introduced into the internal thread of the fastening element 500, thereby fixing the fastening element 500 in the first position I, in which engagement of the bottom rib 404 of the monitoring device housing 402 in the front face engaging segment 302, engagement of the positioning rib 406 in the front face slot 306, engagement of the bottom rib 508 of the fastening element 500 in the rear face engaging segment 304 and engagement of the positioning rib 512 of the fastening element 500 in the rear face slot 306 cause a form fit to be formed.

REFERENCE CHARACTERS

100 Refrigeration appliance
102 Right refrigerator door
104 Left refrigerator door
106 Side wall
108 Refrigeration appliance front face
110 Refrigeration appliance rear face
112 Ice cube maker
114 Connector
200 Machine chamber
202 Compressor
300 Support rail
302 Front face engaging segment
304 Rear face engaging segment
306 Front face slot
308 Rear face slot
400 Monitoring device
402 Monitoring device housings
404 Bottom rib
406 Positioning rib
408 Front Face
410 Rear face
410 Rear face
412 Water stop valve
414 Water leak detection device
416 Lower housing half
418 Upper housing half
420 Latching connection element
422 Hose clip
424 Collection trough
426 Receiving chamber
428 Hose
500 Fastening element
504 Screw boss
506 Screw

508 Bottom rib
510 Fixing screw
512 Positioning rib
600 Overlapping ribs
A Arrow
D Rotation axis
X Refrigeration appliance depthwise direction
Y Refrigeration appliance widthwise direction
Z Refrigeration appliance heightwise direction
I First position
II Second position

The invention claimed is:

1. A refrigeration appliance, comprising:

a refrigeration appliance housing having an interior;

a refrigeration appliance machine chamber;

a support rail for a compressor, said support rail being disposed in said machine chamber, said support rail having an engaging segment and a slot;

a water-conducting conduit system having a connector configured to connect to a domestic water supply system; and a monitor configured to detect water leaks in said water-conducting conduit system of the refrigeration appliance, said monitor having a water leak detector disposed in said machine chamber in said interior of said housing, said water leak detector being form-lockingly fastened to said support rail;

said monitor having a monitor housing divided into directly interconnected upper and lower housing halves, said monitor housing having a bottom rib directly engaging in said slot, and said monitor housing having a fastener directly connecting said monitor housing to said engaging segment.

2. The refrigeration appliance according to claim 1, which further comprises a water stop valve connected to said monitor, said monitor switching said water stop valve from an open to a blocking state when a water leak is detected.

3. The refrigeration appliance according to claim 1, wherein said conduit system has a lowest point, and said water leak detector is disposed at said lowest point.

4. The refrigeration appliance according to claim 1, wherein said monitor housing has a collection trough formed in said monitor housing for leaked water.

5. The refrigeration appliance according to claim 1, wherein said monitor housing has a receiving chamber for said water leak detector.

6. The refrigeration appliance according to claim 1, wherein said monitor housing has a hose clip.

7. The refrigeration appliance according to claim 1, which further comprises a latching connection interconnecting said upper housing half and said lower housing half.

8. The refrigeration appliance according to claim 1, wherein:

said fastener is configured to pivot between a first position and a second position, and said bottom rib extends horizontally and engages said engaging segment in said first position and disengages said engaging segment in said second position.

9. The refrigeration appliance according to claim 1, wherein said support rail has an upper surface for supporting the compressor.

10. A refrigeration appliance, comprising:

a water-conducting conduit system having a connector configured to connect to a domestic water supply system;

a support rail having an engaging segment and a slot; and a monitor configured to detect water leaks in said water-conducting conduit system of the refrigeration appliance, said monitor having a housing with a collection trough for leaked water;

said monitor housing being divided into directly interconnected upper and lower housing halves, said lower housing half and said collection trough being formed as a single piece, said monitor housing having a bottom rib directly engaging in said slot, and said monitor housing having a fastener directly connecting said monitor housing to said engaging segment.

* * * * *